United States Patent [19]

Detmold

[11] 4,334,624

[45] Jun. 15, 1982

[54] DRAFT GEAR LOCKING DEVICE

[76] Inventor: Peter J. Detmold, 40 St. Andrews Rd., Baie d'Urfe, Québec, Canada, H9X 2V1

[21] Appl. No.: 79,051

[22] Filed: Sep. 26, 1979

Related U.S. Application Data

[63] Continuation-in-part of Ser. No. 41,827, May 23, 1979, abandoned, which is a continuation-in-part of Ser. No. 900,164, Apr. 26, 1978, abandoned.

[51] Int. Cl.[3] ..... B61G 9/08; B61G 9/16

[52] U.S. Cl. ..... 213/43; 188/300; 213/8

[58] Field of Search ..... 213/8, 22–25, 213/37, 39, 41, 43; 188/300; 303/69

[56] References Cited

U.S. PATENT DOCUMENTS 1,488,853 4/1924 Webb, Sr. ..... 213/43

*Primary Examiner*—Randolph A. Reese

[57] ABSTRACT

A lock-out apparatus for shock absorbing draft gear on a railway car which draft gear has a housing adapted to be fixed to one end of the railway car, a shock absorber is provided in the housing to cushion shock on the coupler of a railway car at the one end. The shock absorber includes at least one movable shock absorbing member operatively connected to the coupler and a cushion cooperating with the movable member to cushion shock. The lock-out apparatus has a locking member slidably mounted in the housing for movement between a locking and an unlocking position. There is a fluid motor for moving the locking member, and a conduit connecting the fluid motor to a brake line on the railway car whereby a change in the pressure of the fluid in the brake line will operate the fluid motor to move the locking member to a locking position to prevent movement of the movable shock absorbing member and to thus lock out the draw gear.

15 Claims, 9 Drawing Figures

DRAFT GEAR LOCKING DEVICE

CROSS-REFERENCE WITH OTHER APPLICATION

This application is a continuation-in-part of application Ser. No. 041,827, filed May 23, 1979 which is a continuation-in-part of application Ser. No. 900,164, filed Apr. 26, 1978, both of which are abandoned.

BACKGROUND OF THE INVENTION

1. Field of the Invention

The present invention relates to railroad draft gear and more particularly to a lockout control apparatus for locking a shock absorbing draft gear against relative damping movement when a railroad train is travelling in over-the-road conditions in order to reduce train action.

2. Description of the Prior Art

Shock absorbing draft gears are well known wherein each railroad car is provided at each end thereof with a coupler operatively connected to shock absorbing means arranged in a housing whereby the coupler is cushioned when subjected to shock. The shock absorbing means can be hydraulic or mechanical.

However, even though the longitudinal movement of such couplers is limited to within a few inches, it is obvious that in a train, especially comprising 100 cars or more, the accumulative effect of either the cars buffing together or drafting during over-the-road travel causes undesirable oscillations known as train action and can result in derailment.

Lock-out type draft gear have been suggested such as in U.S. Pat. No. 3,236,395, Peterson 1966. In that Patent, a draft gear of the dual sliding sill type is provided with pivoting locking plates in order to mechanically lock the draft gear against buffing in response to a decrease in pressure in the train brake line.

U.S. Pat. No. 3,414,134, Nealis 1968 shows a hydraulic lock-out device where the draw bar is in the form of a piston in the housing which acts as the cylinder. A fluid passageway is provided to allow circulation between the chambers formed on both sides of the piston head and a gate valve is operable to block the passageway thus locking out the draw gear.

The gate valve is controlled by separate control means associated with the throttle and the braking system of the train. It would appear that all of the cars of a single train would need to be so modified before the lock-out system can be used.

SUMMARY OF THE INVENTION

The object of the present invention is to provide a simplified, improved, lock-out apparatus for shock absorbing draft gear, and improved draft gear incorporating such lock-out apparatus.

The lock-out apparatus of the present invention can be used with hydraulic, or with mechanical, shock absorbing draft gear and provides for complete lock-out of the draft gear.

The lock-out system is independent on each car and is completely integrated to the braking system, operating without additional controls or connections between the cars.

The invention is directed toward lock-out apparatus for shock absorbing draft gear on a railway car which draft gear has a housing adapted to be fixed to one end of the railway car. Shock absorbing means in the housing cushion shock on the coupler of the railway car at the one end. The shock absorbing means include at least one movable shock absorbing member operatively connected to the coupler and cushion means cooperating with the member to cushion shock. The lock-out apparatus has a locking member slidably mounted in the housing for movement between locking and unlocking positions, and moving means for moving the locking member. Means connect the moving means to a brake line on the railway car. A change in the pressure of the fluid in the brake line will operate the moving means to move the locking member to a locking position to prevent movement of the movable shock absorbing member.

In one embodiment the movable shock absorbing member is hydraulically cushioned.

In another embodiment the movable shock absorbing member is mechanically cushioned.

A specific construction in accordance with one embodiment of the present invention comprises an elongated housing adapted to be fixed at one end to a freight car, a movable member slidable within said housing and mounting a railroad coupler, the movable member defining a hydraulic chamber at the other end thereof, a piston head within said hydraulic chamber dividing the chamber into a pair of hydraulically sealed sub-chambers; the piston head being fixed relative to the housing; at least a restricted passage communicating one sub-chamber to the other so that fluid will pass from one sub-chamber to the other as external pressure acts to move the movable member relative to the piston head; valving means movable relative to the piston head between a first position clear of the fluid passage and a second position blocking the passing of fluid through said passage; the valving means directly connected to an actuating piston head or diaphragm in a separate fluid motor, the separate fluid motor communicating with the train line such that the actuating piston will respond to a build-up or reduction of pressure in the train line, thus causing the valving means to close the passage of fluid in the passage thus locking the shock absorbing draft gear and clearing the passage when the actuating piston is urged in the opposite direction, as pressure in the train line is reduced.

BRIEF DESCRIPTION OF THE DRAWINGS

Having thus generally described the nature of the invention, reference will now be made to the accompanying drawings, showing by way of illustration, two embodiments thereof, wherein.

DESCRIPTION OF THE PREFERRED EMBODIMENTS

Figure 1:
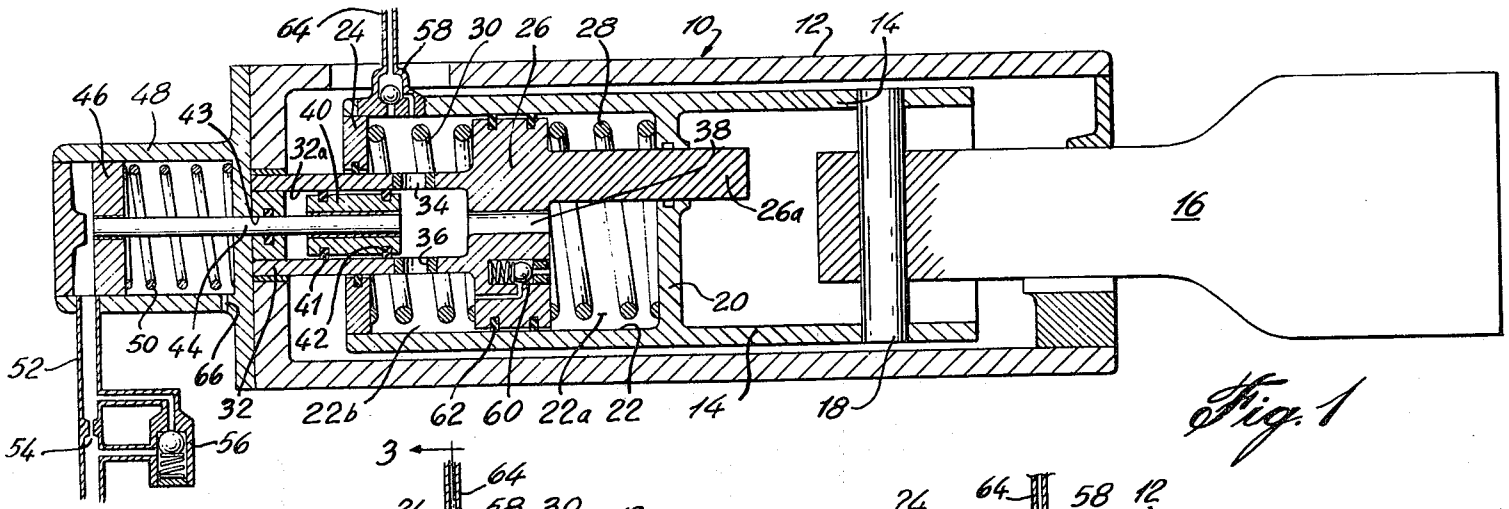
FIG. 1 is a longitudinal cross-sectional view of one type of draft gear embodying the present invention.
Figure 3:
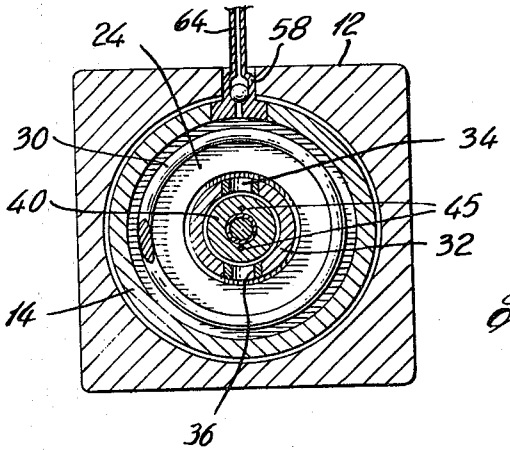
FIG. 3 is a vertical cross-section taken along line 3—3 in FIG. 2.
Figure 2:
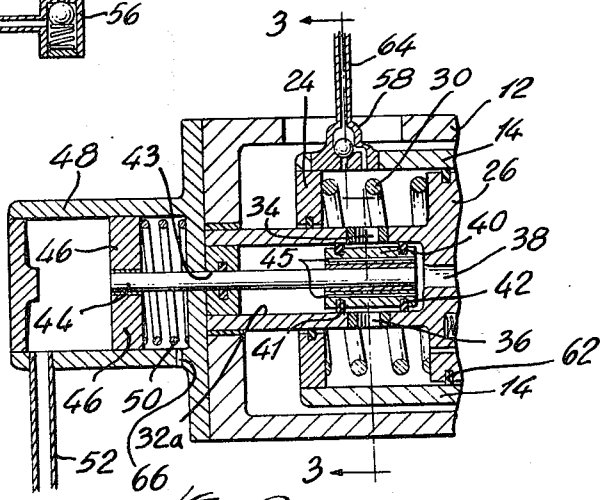
FIG. 2 is a fragmentary cross-sectional view similar to FIG. 1, showing a detail thereof in a different operational position.

Referring now to FIGS. 1 to 3, there is shown a draft gear 10 having a housing 12 which is fixed at the end of a railroad car to the end of the sill (not shown).

A movable damper cylinder 14 slides within the housing 12 and mounts at one end thereof a coupler 16.

Coupler 16 is anchored to the damper cylinder 14 by means of pin 18, allowing the coupler to swivel laterally. If desired, the end of the coupler 16 may be fitted with a hemispherical buffing cap located in the housing (not drawn) integral with the damping cylinder 14 for the purpose of protecting pin 18 from excessive shock forces. The damper cylinder 14 defines a chamber 22 closed off by the median wall 20 and end wall 24.

A piston head 26 which slides in the chamber 22 and is sealed by means of rings 62 with the inner wall of the chamber 22, divides the chamber into sub-chambers 22*a* and 22*b*. Also present in the sub-chambers 22*a* and 22*b* are coil springs 28 and 30 respectively. The coil springs act to keep the piston head 26 at its rest position centrally of the chamber 22. The self-centering spring device may be fitted externally to housing 12 if desired. In this case an external lug would be fitted to damper cylinder 14 and would extend through a slot in housing 12. The piston 26 is fixed relative to the housing 12 by means of a hollow cylindrical integral member 32 fixed to the end wall of the housing 12. A passage 38 extends along the longitudinal axis of the piston head 26 and communicates the sub-chamber 22*a* with the bore 32*a* formed in the cylindrical member 32. Orifices 34 and 36 communicate the bore 32*a* with the sub-chamber 22*b*.

The piston 26 has a projection 26*a* in order to compensate in chamber 22*a* the displacement caused by member 32 in chamber 22*b*. Projection 26*a* slides in a seal through an orifice in the median wall 20. If preferred, chamber 22*b* could be connected to a pressure reservoir capable of accommodating hydraulic fluid displaced through the movement of piston 26 in chamber 22.

A piston 40 which has sealing rings 41 and 42, is fixed to one end of a rod 44 while the other end of the rod passing through a bore 43, is connected to a piston head 46 in the air cylinder 48.

The piston 40 is capable of sliding in the bore 32*a* between a piston shown in FIG. 1, such that orifices 34 and 36 are in direct communication with the passage 38, and a position shown in FIG. 2 whereby the piston 40 blocks the communication between the orifices 34, 36 and the passage 38.

A spring 50 is also provided in the air cylinder 48 to return the piston to its normal position shown in FIG. 1. The air cylinder 48 communicates with an inlet pipe 52 which, in turn, is connected to the brake line of the train. The build-up of air pressure in the brake line of the train forces the piston 46 to move, compressing the spring 50 while at the same time moving the piston 40 to a position shown in FIG. 2, where it blocks communication between the passage 38 and the orifices 34 and 36. When the air pressure drops in the line 52 from the brake line, that is when the brakes are being fully applied to the train, (such as in an emergency) the spring 50 overcomes the air pressure and the air cylinder 48, and urges the piston 46 to return to position shown in FIG. 1, where the passage 38 communicates with the orifices 34 and 36. Orifice 66 vents the spring end of the air cylinder 48 to atmosphere.

The valving piston 40 may include longitudinal drill hole 45, which communicates the rear of the bore 32*a*, that is, behind the piston head 40, with the passage 38. Such an arrangement will prevent locking of the piston 40 and dampen the movement of the piston 40 in reaction to the pressure in the air cylinder 48. The selection of the relative cross-sectional areas of piston 40 and rod 44 will adjust the residual force on the rod in response to varying hydraulic pressure to a level which will prevent the rod from moving inadvertently. Similarly, a relief valve 60 is provided in the piston head 26 which, in emergencies, will communicate the sub-chamber 22*b* with the sub-chamber 22*a*, that is, if an excessive shock is received at the coupler 16, as in a collision, the pressure in the sub-chamber 22*a* will overcome the spring of the check valve 60, allowing fluid to pass from the chamber 22*a* to the chamber 22*b* even though the piston 40 might close off the orifices 34 and 36. An additional relief valve operating in the reverse direction and designed to relieve excessive hydraulic pressures during high draw loads is not shown, but may be fitted if desired.

Similarly, a stack pipe 64 with suitable non-return valve 58 communicates an oil reservoir with the chamber 22*b*. In case of a build-up of high pressure in the chamber 22*b*, the ball in the non-return valve 58 in the stack pipe 64 will lift, preventing the fluid under pressure from returning up the stack pipe to flood the reservoir (not shown).

A restrictor 54 may be inserted in the air line 52 between the brake line and the air cylinder 48. This has the effect of delaying the action of the lock-out by delaying the build-up of air pressure in the air cylinder 48. A check valve 56 can by-pass the restriction 54, such that air will return quickly to the brake line when the spring 50 urges the piston 46 back to a normal position.

In operation, in a normal freight yard operation, whereby rail cars may be standing without being connected to the locomotive, the brake line will normally be at zero pressure and certainly below a normal charged-up pressure. In such a situation, the draft gear 10 will be in a position shown in FIG. 1, that is, with the piston 46 retracted in the air cylinder 48, thus the valving piston 40 is retracted to allow free flow of oil through the orifices 34, 36 and the passage 38 allowing the normal damping of shock absorbing action of the damping cylinder 14 to take place. In the case of sudden coupling with an oncoming rail car, the coupler 16 will move rearwardly moving the damping cylinder 14 against the spring 28, between the fixed piston 26 and the wall 20 of the damping cylinder 14. The oil present in the sub-chamber 22*a* will pass through passage 38, the orifices 34 and 36, to the sub-chamber 22*b*. The time and friction of the movement of the oil will provide the shaft shock absorbing function or damping effect of the draft gear 10.

When it is required to move the train, including cars with draft gears of the present invention, the brake line is charged up to a normal pressure of 75 to 85 PSI. The air pressure in the brake line as it is being charged up will pass through the air line 52, pass the restrictor 54, and under delayed reaction, build up pressure in the air cylinder 48, forcing the piston 46 against the spring 50, thus closing the orifices 34 and 36 by means of the valving piston 40, which takes up the position as shown in FIG. 2. Thus, when the train is travelling at over-the-road speeds, the draft gear will be completely locked out, since the oil will no longer be able to pass from the sub-chamber 22*a* to the sub-chamber 22*b*, thus preventing the damping cylinder 14 from sliding in the housing 12. If there is however a sudden overwhelming shock, the check valve 60 will relieve the oil in the chamber 22*a*, and allow it to pass to the chamber 22*b*.

The spring 50 may be chosen such that the spring will return the piston 46 to its normal position, thereby allowing the oil to flow through the orifices 34, 36 and passage 38 only at a substantial drop in pressure, to approximately 50 PSI. Thus, if the brakes are applied fully and suddenly, the pressure in the brake line will drop below 50 PSI. Accordingly, if on an over-road-operation, the emergency brakes are applied or the brakes are used suddenly such that the brake pressure does go below 50 PSI, if it is so desired, the spring 50 will overcome the pressure in the air cylinder 48, thus urging the piston 46 to its normal position, and retracting the valving piston 40, allowing the normal damping action of the draft gear 10.

If the train is started immediately the brakes are released, the driver will be able to bunch the train if he wishes because restrictor 54 will have prevented full movement of piston 46, delaying locking action until the train is in motion.

Figure 4:
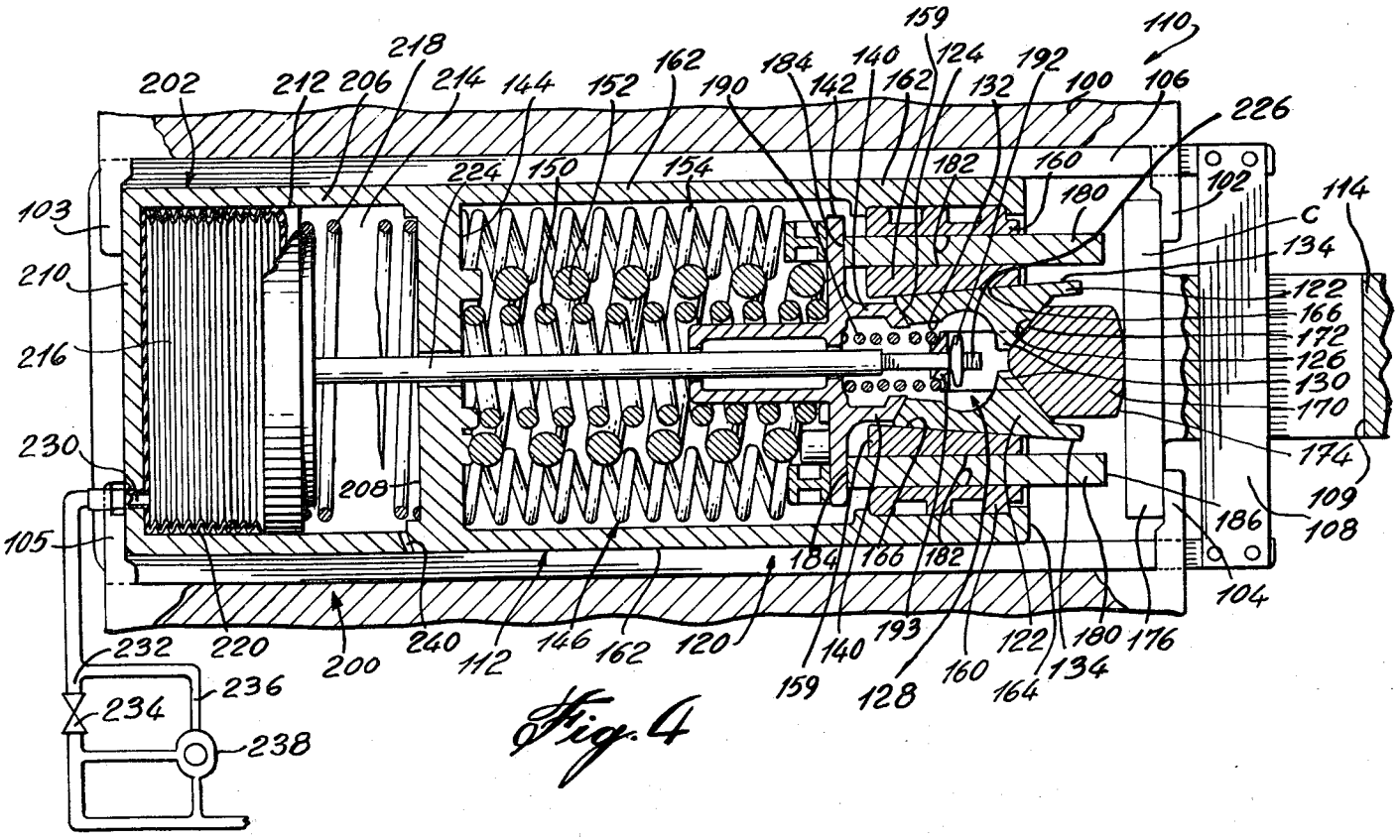
FIG. 4 is a longitudinal cross-sectional view of another type of draft gear, in a rest position, embodying the present invention.
Figure 5:
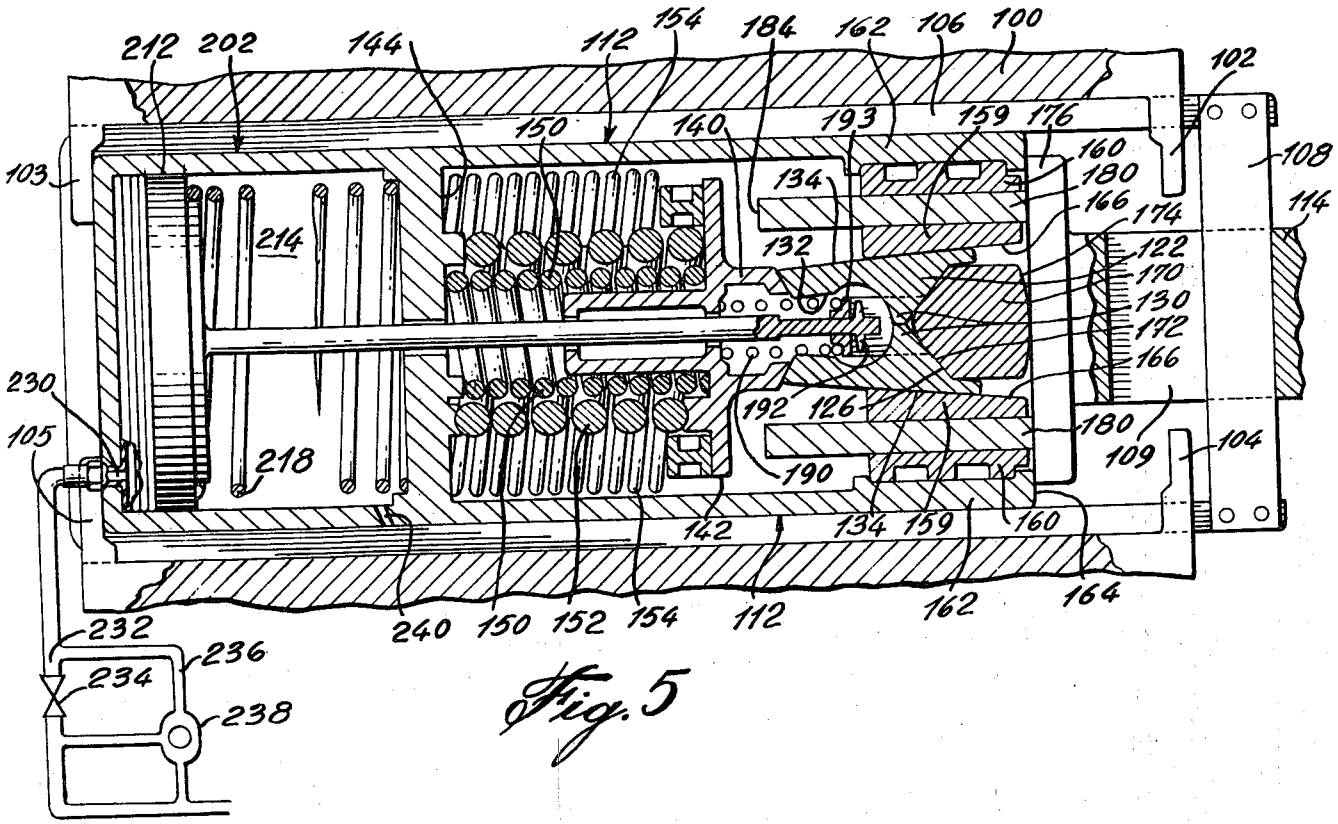
FIG. 5 is a view similar to FIG. 4 showing the lock-out apparatus operational.
Figure 6:
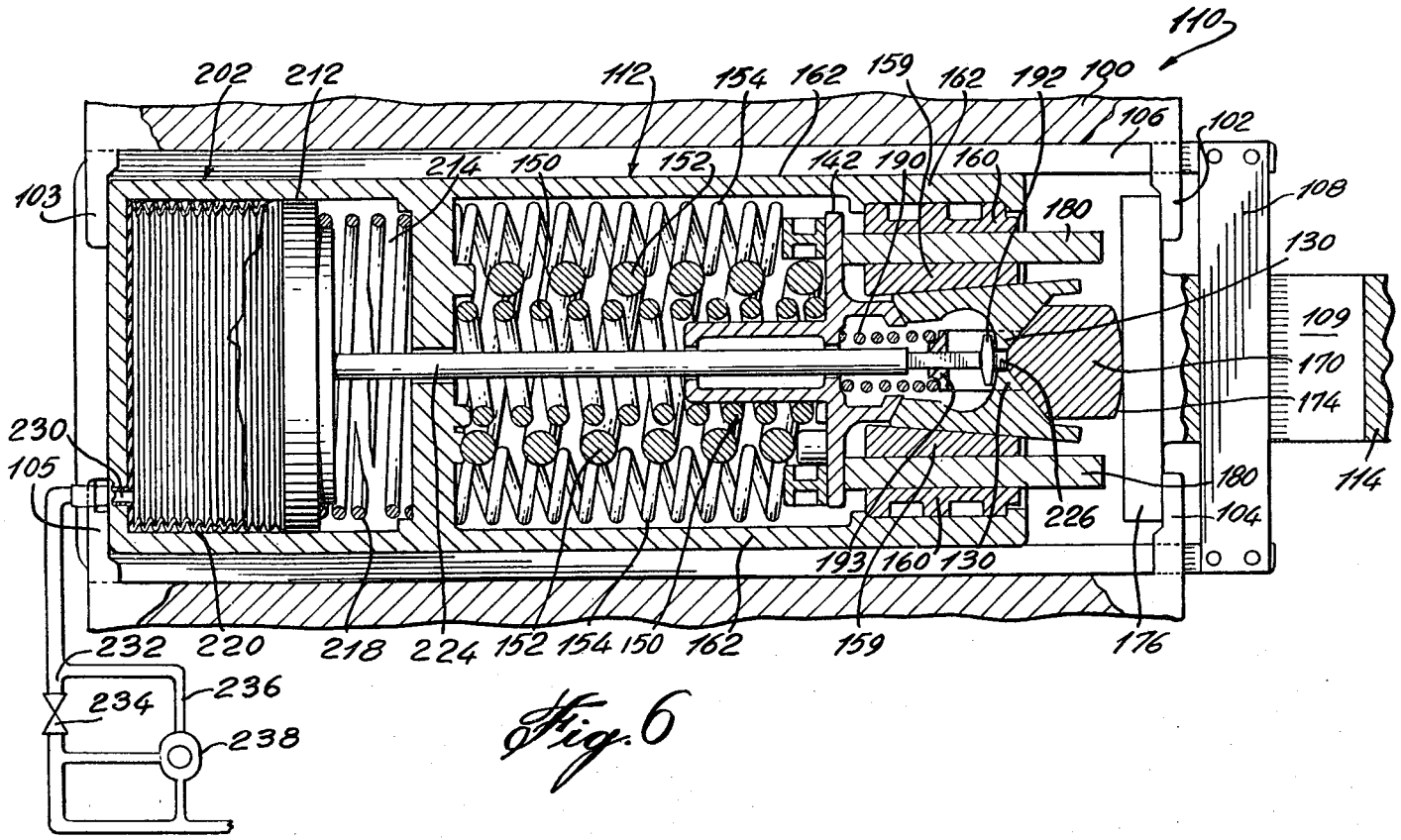
FIG. 6 is a view similar to FIG. 4 showing the draft gear in an operational position.

In a second embodiment of the present invention, the lock-out apparatus can be adapted for use with draft gear having mechanical shock absorbing means. As shown in FIGS. 4 to 6, the draft gear 110 has a housing 112 adapted to be located in a sill 100 of a railway car at one end of the car. The coupler 114 on the railway car is mounted slidably within the sill 100 by means of follower plate 176 abutting against the stop members 102 and 104. A yoke 106 is fixed to the housing 112 and includes a yoke bar 108 traversing a slot 109 defined in the coupler 114. Sill 100 also mounts stops 103 and 105 at the other end thereof to limit the travel of housing 112.

The draft gear 110 contains shock absorbing means 120 to cushion shock applied to the coupler 114. The shock absorbing means 120 are a well-known mechanical friction type and include a pair of movable wedge shoes 122 and a pair of movable plates 180 slidably mounted in the housing 112. Each wedge shoe 122 is in the form of a tapered plate having a narrow sloping edge 124 at one end and a wide sloping edge 126 at its other end. The wedge shoes 122 define a small chamber 128 between them, the chamber 128 partly closed at one end by a jaw 130 projecting from the inner surface 132 of each plate toward the other plate. The outer surface 134 of each plate slopes relative to inner surface 132 between edges 124 and 126 and provides a friction surface as will be described.

The narrow sloping edges 124 of the wedge shoes 122 rest on angled abutments 140 projecting from a spring seat 142 slidably mounted within the housing. The spring seat 142 is spaced from the end wall 144 of the housing 112 forming a chamber 146. Cushion means are provided in chamber 146 to absorb shock and comprise an arrangement of coil springs designed to provide the desired damping for the coupling loads. The coil spring arrangement includes a small, centrally located inner coil spring 150, a larger, centrally located outer coil spring 152 concentric about spring 150, and four corner coil springs 154 (two of which are shown) about the central coil springs 150, 152. All the springs 150, 152 and 154 are mounted between the housing end wall 144 and spring seat 142.

The wedge shoes 122 are slidably mounted between a pair of tapered and opposed stationary blocks 159 mounted between stationary blocks 160 fixedly mounted on opposed side walls 162 of the housing 112 adjacent the other end 164 of the housing. Each block 159 has an inclined surface 166 along which a wedge shoe 122 abuts via its outer surface 134. The surfaces 166 slope toward each other inwardly from the end 164 of the housing. A center wedge 170 is located adjacent the wedge shoes 122 with one V-shaped side 172 abutting sloping edges 126 of both shoes. The center wedge 170 is centered with respect to the shoes 122 and normally extends outwardly of the housing with its other side 174 abutting against a follower plate 176 on the coupler 114.

A pair of movable plates 180 are also provided, each slidably mounted in a slot 182 in stationary blocks 160. The plates 180 extend generally parallel to the springs 150, 152, 154 and are longer than the stationary blocks 160 to project from each side of the block. One side 184 of the plates 180 abuts the spring seat 142 when the draft gear 110 is in the rest position as shown in FIG. 4. The other side 186 of the plates 180 is slightly spaced from the follower plate 176. A release spring 190 is mounted in the chamber 128 between wedge shoes 122 and abuts a bar 193 which is an integral part of center wedge 170 at one end adjacent jaws 130 of wedge shoes 122.

The construction of the draft gear described above is well known. In accordance with the present invention, lock-out apparatus can be provided on this draft gear. The lock-out apparatus 200 includes a fluid motor 202 fastened to the end wall 144 of the housing 112. The fluid motor 202 comprises a casing having a cylindrical body 206 closed by end walls 208, 210. A piston 212 is slidably mounted within body 206 dividing the interior of the body into two chambers 214, 216. A coil spring 218 is located in chamber 214 between piston 212 and end wall 208. A flexible diaphragm 220 is located in chamber 216 between piston 212 and end wall 210.

A locking member 224 projects from piston 212 through end wall 208, which also forms end wall 144 for chamber 146, and into the chamber 128 through springs 150 and 190. The locking member 224 passes through bar 193 and a short projection 226 protrudes axially from the free end of locking member 224. An inlet port 230 is provided in the other end wall 210 of fluid motor 202. A line 232, connected to the brake line (not shown) of the railway car, connects to port 230. A flow restrictor 234 can be provided in line 232 as can a bypass line 236, bypassing restrictor 234. A one-way ball valve 238 is provided in bypass line 236. A vent 240 for chamber 214 can be provided in the body 206 of motor 202.

In operation, when movement of the coupler is to be cushioned against buff forces, as when shunting in a railway yard, the coupler 114 compresses the cushion means with the housing 112 against the stops 103 and 105, via follower plate 176, and moves the center wedge 170 into the housing 112 against the wedge shoes 122, pushing them toward the far end wall 144 of the housing 112 as seen in FIG. 5. The wedge shoes 122 push the spring seat 142 against the coil springs 150, 152, 154 compressing them to cushion shock. At the same time, the wedge shoes 122 frictionally engage the stationary blocks 159 via sloping surfaces 134, 166 to aid in absorbing shock. As the wedge shoes 122 move inwardly, they also move toward each other. At this time, the brake line pressure in line 232 is substantially at atmospheric, and the spring 218 in the fluid motor 202 keeps the locking member 224 in an unlocked position with the locking projection 226 on the member spaced from the jaws 130 on the wedge shoes 122. The locking member 224 is free to move as wedge shoes 122 move since there is no back pressure in chamber 216 of motor 202.

In the case of draw forces, the coupler will pull the yoke 106 moving the housing 112 towards the right against the follower plate abutting against stops 102 and 104. The same compression of the cushion means will apply as described above.

When a train is made up, the train brakes are released in preparation to travel and brake line pressure now passes through line 232 into chamber 216. The brake pressure moves the piston 212, and attached locking member 224 to a locking position. In this position, the projecting tongue 226 slides snugly between the jaws 130 of the wedge shoes 122 as seen in FIG. 6. The wedge shoes 122 now cannot move to the left to damp coupler movement since tongue 226 prevents the wedge shoes 122 from coming together. The coupler is prevented from moving and is thus effectively locked out during train travel.

The restrictor 234 in line 232 delays operation of the lock-out apparatus for a predetermined period of time after the brakes are released to allow the engineer to "bunch" the cars during starting.

The diaphragm 220 minimizes leakage of brake line fluid past piston 212 into chamber 214 and even if such leakage occurs, vent 240 prevents any undue build-up of pressure in the chamber 214.

Full damping could be restored to the draft gear in an emergency situation by selecting the diameter of the piston 212 and the strength of the spring 218 to be such that the tongue 226 is withdrawn from the jaws at some predetermined brake line pressure consistent with emergency brake application. The ball valve 238 would avoid delay in reducing the pressure in chamber 216 in an emergency situation.

Figure 7:
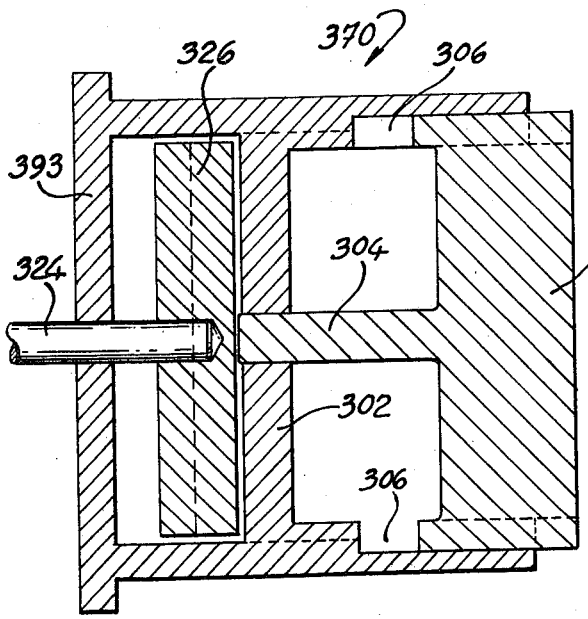
FIG. 7 is a fragmentary vertical cross-section of an embodiment of a detail shown in FIGS. 4, 5 and 6.
Figure 8:
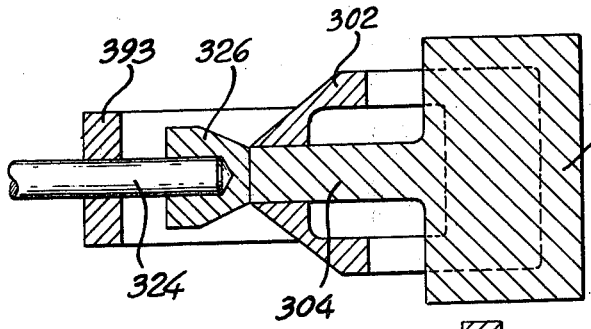
FIG. 8 is a horizontal cross-section taken along lines 8—8 of FIG. 7.
Figure 9:
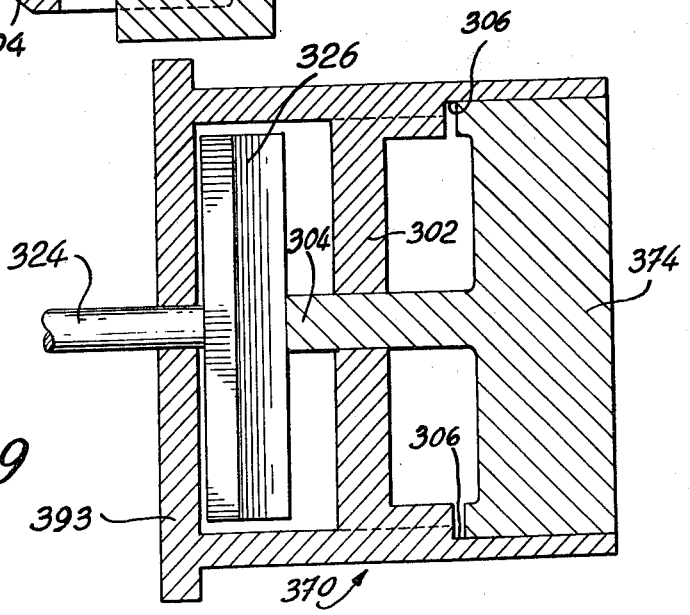
FIG. 9 is a vertical cross-section similar to FIG. 7 showing the elements in a different operative position.

FIGS. 7, 8 and 9 show an embodiment of a means for restoring full damping to the mechanical draft gear (FIGS. 4, 5 and 6) in an emergency situation. In the case of the embodiment shown in FIGS. 7, 8 and 9, the center wedge 370 is shown being made up of segments with one segment being moveable, instead of the solid center wedge 170 shown in the earlier embodiments. The bar 393 is integral with the wedge body portion 302. A sliding segment 374 forming part of the center wedge 370 slides within a hollowed out portion of segment 302 in grooves 306. The sliding segment 374 mounts a pusher rod 304. The pusher rod 304 slides through a bore provided in wedge part 302.

As shown in FIG. 7, the hollow space provided in the hollowed out wedge member 370 could be filled with blocks 306 which may be made of tough synthetic material or rubber such as to compress only under very heavy loads. Other resilient devices could also be provided in this space.

The wedge 370 would operate under normal circumstances in the same manner as wedge 170 described above. However, in the case of a severe shock, the follower plate 176 would press against the wedge part 374 compressing the resilient blocks 306 and forcing the pusher rod 304 to slide through the bore of part 302 to push the tongue 326 from its locked position shown in FIG. 6. Once the tongue 326 is disengaged from the position shown in FIG. 6, the buffing action of the draft gear is reinstated. The pusher rod 304 would immediately return to its normal position after the first initial shock is transmitted, by means of the resilient blocks 306.

I claim:

1. A lock-out apparatus for shock absorbing draft gear on a railway car provided with a conventional single pipe fluid brake system, which draft gear has a housing adapted to be fixed to one end of the railway car and shock absorbing means in the housing to cushion shock on the coupler of the railway car at the one end, the shock absorbing means including at least one movable shock absorbing member operatively connected to the coupler and cushion means cooperating with the movable member to cushion shock; a lockout apparatus having a locking member slidably mounted in the housing for movement between locking and unlocking positions, piston and cylinder means for moving the locking member, and conduit means connecting the piston and cylinder means to the single pipe of the fluid brake system on the railway car whereby an increase in the pressure of the fluid in the brake line will automatically operate the piston and cylinder means to move the locking member to a locking position to prevent movement of the movable shock absorbing member and to thus lock out the draft gear whenever the train is fully assembled and running in a normal manner.

2. A lock-out apparatus as claimed in claim 1, including restriction means in the conduit means connecting the piston and cylinder means to the single line of the brake system.

3. A lock-out apparatus as claimed in claim 2, including a line bypassing the restriction means and a one-way valve in the bypass line.

4. A lock-out apparatus for shock absorbing draft gear on a railway car, which draft gear has a housing adapted to be fixed to one end of the railway car and shock absorbing means in the housing to cushion shock on the coupler of the railway car at the one end, the shock absorbing means having two movable members with facing jaws, the movable members frictionally cooperating with fixed members and with springs to cushion shock, a lock-out apparatus having a locking member slidably mounted in the housing for movement between locking and unlocking positions, moving means for moving the locking member, and means connecting the moving means to a brake line on the railway car, the locking member movable between the jaws of the movable members in the locking position to prevent their movement and to thus lock out the draft gear.

5. A lock-out apparatus as claimed in claim 4, wherein the moving means comprises a piston slidable in a cylinder, the locking member connected to the piston and projecting out from one end of the cylinder, the connecting means connected to the other end of the cylinder.

6. A lock-out apparatus as claimed in claim 5, including restriction means in the means connecting the moving means to the brake means.

7. A lock-out apparatus as claimed in claim 6, including a line bypassing the restriction means and a one-way valve in the bypass line.

8. A lock-out apparatus as defined in claim 5, wherein the locking member includes an elongated rod connected to said piston and extending axially of the housing and being adapted to move axially from a position clear of the jaws such that the draft gear is in a buffing condition and a position engaged between the jaws locking the jaws such as to lock out the draft gear in response to an increased fluid pressure in the cylinder, thus moving the piston and the locking member towards said locking position.

9. A lock-out apparatus as defined in claim 8, wherein means are provided for disengaging the locking member for between the jaws in the case of a sudden shock so as to return the draft gear to its buffing condition, wherein said means include a compressible member made up of two parts, one sliding within the other, the one part being connected to the coupler and the one part including a projection extending axially of the housing and aligned with the locking member, such that when a sudden large impact is transmitted by the coupler to the one member, the compressible member will be compressed allowing the projection to extend axially and disengage the locking member from between the jaws when the draft gear is in a lock-out position.

10. A lock-out apparatus as defined in claim 4, wherein means are provided for disengaging the locking member from between the jaws in the case of a sudden shock so as to return the draft gear to its buffing condition.

11. An automatic lock-out device for shock absorbing draft gear in which the draft gear includes an elongated housing adapted to be fixed at one end of a railroad car, a movable tubular member slidable within the housing and mounting a coupler at one end thereof, the movable member defining a hydraulic chamber at the other end thereof, a piston head mounted on a piston stem extending axially of the housing and mounted at one end to the housing, said piston head being within said hydraulic chamber and dividing the chamber into a pair of hydraulically sealed sub-chambers, the piston stem being partially hollow and defining a bore therein, at least a restricted passage defined in the piston head and the hollow stem communicating one sub-chamber to the other so that fluid will pass from one sub-chamber to the other as external pressure acts on the coupler to move the movable tubular member relative to the piston head; valving means including a valve piston slidable in the bore of the stem between a first position clear of the fluid passage and a second position blocking the passing of fluid through said passage; the valve piston being directly connected to an actuating means in a separate fluid motor; the fluid motor communicating with a brake line of the railroad car such that the actuating means will respond to a build-up or reduction of pressure in the brake line, thus causing valve piston to close the passing of fluid in the fluid passage, thus locking the shock absorbing draft gear and, when the actuating means is urged in the opposite direction, clearing the passage.

12. A lock-out device as defined in claim 10, wherein the piston stem is fixed to the housing extending axially of the piston, the stem being provided with orifices provided radially in walls of the stem, communicating the bore of the stem radially with the respective sub-chamber; the valve piston adapted to move between the first position which blocks the passage of fluid between the orifices in the walls of the stem, and the passage in the piston head, and a second position clear of the orifices in the stem allowing fluid flow through the passage.

13. A draft gear as defined in claim 11, wherein the means communicating the brake line to the fluid motor include a passage restrictor such as to delay the build-up of pressure in the fluid motor in response to a build-up of pressure in the brake line, whereby the lock-out action of the valving piston will occur subsequent to the build-up of pressure in the brake line.

14. An apparatus as defined in claim 12, wherein non-return relief valve is provided between the sub-chambers for emergency, passing fluid from one sub-chamber to the other, in response to a shock.

15. An apparatus as defined in claim 11, wherein the fluid motor is in the form of an air cylinder and the actuating means is a piston sliding in the air cylinder.

* * * * *